United States Patent [19]

Pesa

[11] 4,099,327

[45] Jul. 11, 1978

[54] FOLDING KNIFE

[76] Inventor: William A. Pesa, 578 Oakley Rd., Wooster, Ohio 44691

[21] Appl. No.: 825,292

[22] Filed: Aug. 17, 1977

[51] Int. Cl.[2] ..... B26B 1/02

[52] U.S. Cl. ..... 30/161

[58] Field of Search ..... 30/155, 156, 157, 158, 30/159, 161

[56] References Cited

U.S. PATENT DOCUMENTS

| | | | |
|---|---|---|---|
| 1,476,123 | 12/1923 | Watson | 30/161 |
| 2,081,232 | 5/1937 | Haas | 30/156 |
| 2,628,423 | 2/1953 | Cuntz | 30/156 |
| 3,568,315 | 3/1971 | Smith | 30/161 |
| 4,027,386 | 6/1977 | Spinosa et al. | 30/156 |

*Primary Examiner*—Jimmy C. Peters

*Attorney, Agent, or Firm*—Ronald P. Yaist; Paul E. Milliken

[57] ABSTRACT

A folding knife including the combination of a blade sandwiched between a pair of bolsters which are connected to a handle and a pivot pin extending between the bolsters and through an end of the blade. The forward edge of each bolster has a surface of an arcuate configuration and the confronting rearward end of the blade has a surface of an arcuate configuration substantially similar to that of the bolsters to permit the blade and bolsters to meet in sliding engagement when the blade is in an opened or closed position. The knife is particularly useful for activities such as hunting or fishing.

13 Claims, 8 Drawing Figures

FOLDING KNIFE

BACKGROUND OF THE INVENTION

This invention relates to knives and more particularly to knives adapted to be folded. This invention specifically involves folding knives used in hunting and fishing or other such activities in which the knife blade is subject to severe stress during use.

Heretofore folding knives have for the most part included the combination of a metal blade sandwiched between a pair of metal or plastic bolsters which are connected to a suitable handle. A single pivot pin has held the bolsters in place and allowed the blade to fold between the bolsters when the knife is closed. Exemplary of the prior art are the folding knives disclosed in U.S. Pat. No. 1,439,507 to Delsing, U.S. Pat. No. 1,994,215 to Gaunt and U.S. Pat. No. 2,502,404 to Allen.

Those skilled in the art are aware that when the knife is used this foregoing arrangement of the knife components results in the transfer of undesirable lateral forces acting on the blade to the pivot pin joint thereby tending to force the bolsters apart and detrimentally affecting the functioning of the knife. This condition is particularly apparent when the knife is used to cut through tough substances such as the bones and hides of animals.

The disadvantages of the prior art have been overcome by the present invention as will be described hereinafter.

OBJECTS OF THE INVENTION

It is a principal object of the present invention to provide a knife of economical construction which has increased strength when used to cut through tough, thick substances.

It is another primary object of the present invention to provide a folding knife structure which will allow for improved distribution of stresses when the knife is used.

It is a further object of the present invention to provide a folding knife including mating arcuate surfaces common to both bolster and blade to permit the blade to be more easily opened and closed.

Other objects and advantages of this invention will become apparent hereinafter as the description thereof proceeds, the novel features, arrangements and combinations being clearly pointed out in the specification as well as the claims thereunto appended.

The foregoing objects and advantages of the invention are accomplished by a folding knife comprising: (A) at least one elongated blade having a cutting portion at one end thereof which is exposed when the blade is in the opened position and a connecting portion at the other end thereof; (B) a handle having a forward end connected to the connecting portion of the blade and having an elongated cavity therein adapted to receive the blade when in a folded position; (C) at least one pair of spaced bolsters at the forward end of the handle disposed on each side of the connecting portion of the blade with each bolster including an undercut portion on the underside thereof to accept the blade when in a folded position; (D) a pivot pin extending transversely between each bolster and through the connecting portion of the blade to maintain a spaced relationship between the bolsters and to allow the blade to fold between the bolsters; and (E) mating surfaces formed both at the forward edge of each bolster and at the rearward end of the connecting portion of the blade in confronting relation thereto, each surface being of substantially similar arcuate configuration to permit the blade and bolster to meet in a sliding fit when the blade is in an opened or closed position thereby transferring any lateral forces acting on the blade to the bolsters and putting a shear stress on the pivot pin rather than forcing apart the bolsters.

The foregoing objects and advantages are also accomplished by providing a knife adapted to be folded comprising the combination of a blade sandwiched between a pair of bolsters which are connected to a handle and a pivot pin extending between the bolsters and through an end of the blade with the improvement wherein the forward edge of each bolster has a surface of an arcuate configuration and the confronting rearward end of the blade has a surface of an arcuate configuration substantially similar to that of the bolsters to permit the blade and bolsters to meet in sliding engagement when the blade is in an opened or closed position.

DESCRIPTION OF THE PREFERRED EMBODIMENTS

Figure 1:
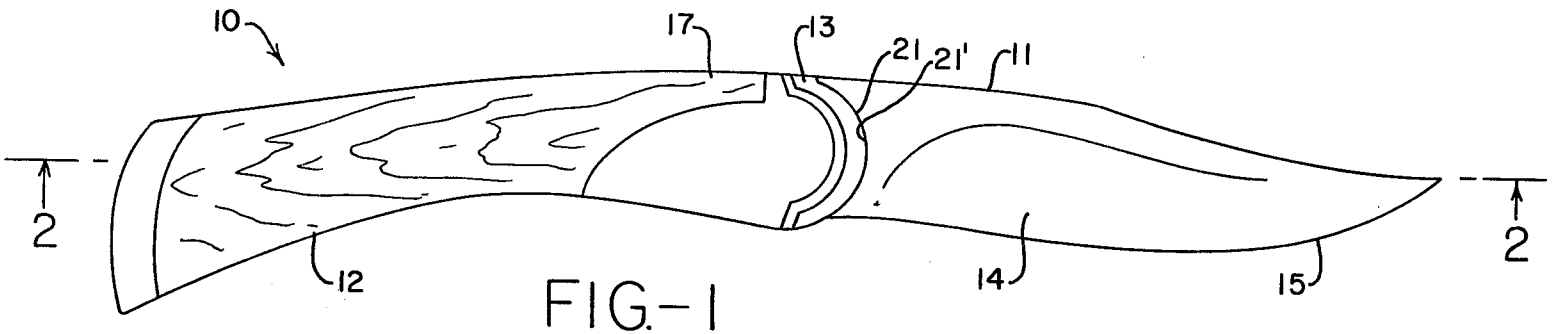
FIG. 1 is a side elevation of the knife of the invention showing the blade in an opened position.
Figure 2:
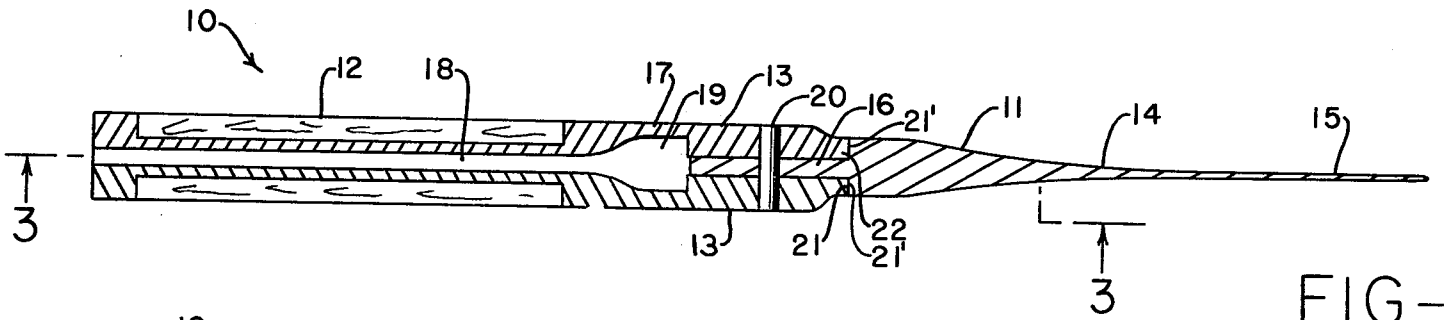
FIG. 2 is a section taken on line 2—2 of FIG. 1.
Figure 3:
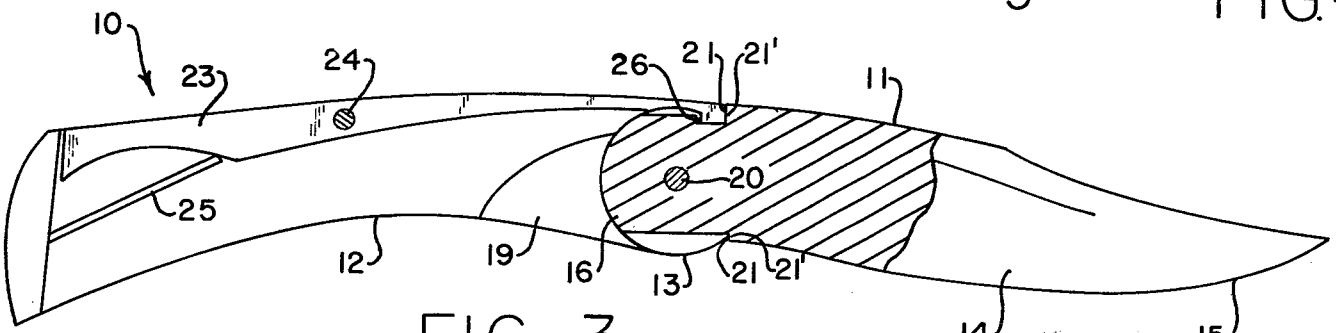
FIG. 3 is a section taken on line 3—3 of FIG. 2.

The knife 10 of the present invention as shown in FIGS. 1 through 3 in an opened condition includes three principal components, a blade 11, a handle 12 and a pair of spaced bolsters 13 connecting the blade 11 and handle 12.

The blade 11 is made of a metal such as steel and is elongated in longitudinal configuration. It has a cutting portion 14 at one end which is exposed when the blade is extended in the opened position with an edge 15 for cutting or slicing and a connecting portion 16 at the opposite end.

Figure 4:
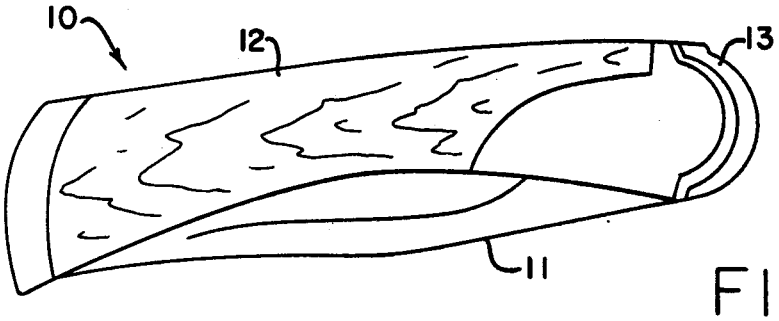
FIG. 4 is a side elevation of the knife of the invention showing the blade in a closed position.

The handle 12 which can be formed of various materials such as metal, rigid plastic, wood or the like, has a forward end 17 which is connected or attached to the connecting portion 16 of the blade 11 and includes an elongated cavity 18 adapted to receive the blade 11 when the knife 10 is closed and the blade is in a folded condition as shown in FIG. 4.

The bolsters 13 are secured to the forward end 17 of the handle 12 and are disposed on each side of the connecting portion 16 of the blade 11 with the blade 11 thereby sandwiched therebetween. As best shown in FIGS. 2 and 3 each bolster 13 includes an undercut portion 19 to accept the blade 11 when in a folded position (FIG. 4). The bolsters 13 can be made of any rigid material such as metal or plastic and serve to hold the blade 11 in place in the knife assembly 10. A pivot pin 20 of metal extends transversely between each bolster 13 and through the connecting portion 16 at an end of the blade to maintain a spaced relationship between the bolster 13 and to allow the blade to pivot and fold between the bolsters 13 into the cavity 18.

In accordance with the present invention, the forward edge of each bolster 13 and the end or connecting portion 16 of the blade 11 have mating surfaces 21 and 21′ of substantially the same or similar arcuate configuration. For example, each surface 21 of the bolsters 13 meet in sliding engagement with surfaces 21′ of the rearward end of the connecting portion 16 of the blade 11 each portion of which is in a confronting relation to a surface 21 as seen in FIG. 2. In this case the connecting portion 16 is of less thickness than the cutting portion 14 which is immediately adjacent thereto to create an inlet 22 with each bolster 13 being placed in its respective inlet 22 thus provided.

The mating arcuate surfaces 21 and 21′ as defined above permit the blade 11 and bolsters 13 to meet in a sliding fit when the blade 11 is in an opened or closed position thereby transferring any side or lateral forces acting on the blade 11 to the bolsters 13. This results in a shear stress being placed on the pivot pin 20 rather than forcing apart the bolster 13. Preferably the surfaces 21 and 21′ have a circular configuration to permit optimum ease of operation and manufacture. The configuration of each surface 21 of the forward edge of the bolsters 13 is convex and that of the rearward end of the connecting portion 16 is concave.

Of course those skilled in the art will recognize that the teachings of the present invention apply equally well to a knife having two or more blades with the blades being on the same or opposite ends of the handle.

The knife 10 may also include means for locking the blade in an opened position. For example as shown in FIG. 3 a locking bar 23 may be provided attached to the bolster by means of a pin 24 and leaf spring 25. The forward end of the bar 23 engages a recess 26 in the blade 14 to lock the blade in the opened position. To unlock the blade 14 the rearward end of the bar 23 is depressed against the spring 25 thereby releasing the forward end of the bar from its engagement with the recess 26.

It is preferred in the practice of the invention that the knife includes means for providing tension to keep the blade in contact with the bolsters. This may be accomplished by a tension device acting on the pivot pin to force the blade toward the forward edge of the bolster between the mating surfaces to provide contact. Examples of such devices operably associated with the blade are shown in FIGS. 5 through 8.

Figure 5:
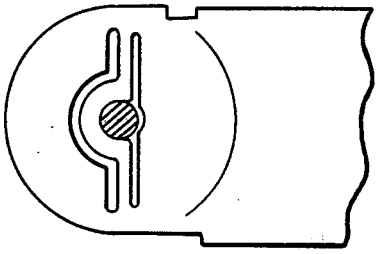
FIGS. 5, 6, 7 and 8 are fragmentary sectional views illustrating modifications of the invention shown in FIG. 3
Figure 6:
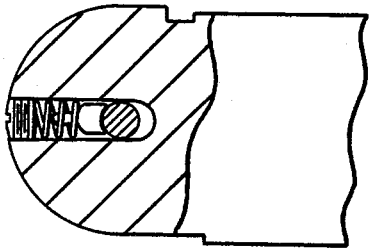
Figure 7:
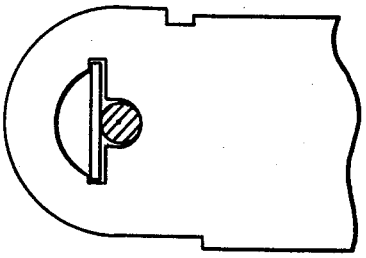
Figure 8:
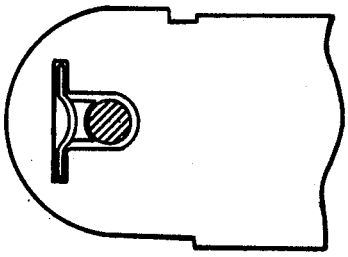

In the embodiment of the invention shown in FIG. 5 an integral spring is operably attached to the connecting portion of the blade to provide tension on the pivot pin. FIG. 6 illustrates that the blade may include a coil spring which operates in like manner for the same purposes. In FIGS. 7 and 8 a bar spring and leaf spring respectively are attached to the blade for the same purpose.

It should be apparent to those skilled in the art that the particular style or contour of the components of the knife such as the blade or handle can vary from those illustrated without departing from the inventive concept.

While certain representative embodiments and details have been shown for the purpose of illustrating the invention, it will be apparent to those skilled in the art that various changes and modifications may be made therein without departing from the spirit and scope of the invention.

What is claimed is:

1. A folding knife comprising:

(A) at least one elongated blade having a cutting portion at one end thereof which is exposed when said blade is in the opened position and a connecting portion at the other end thereof;

(B) a handle having a forward end connected to the connecting portion of said blade and having an elongated cavity therein adapted to receive said blade when in a folded position;

(C) at least one pair of spaced bolsters at the forward end of said handle disposed on each side of the connecting portion of said blades with each bolster including an undercut portion on the underside thereof to accept the blade when in a folded position;

(D) a pivot pin extending transversely between each said bolster and through the connecting portion of said blade to maintain a spaced relationship between said bolsters and to allow said blade to fold between said bolsters; and (E) mating surfaces formed both at the forward edge of each said bolster and at the rearward end of the connecting portion of said blade in confronting relation thereto, each said surface being of substantially similar arcuate configuration to permit the blade and bolster to meet in a sliding fit when the blade is in an opened or closed position thereby transferring any lateral forces acting on the blade to the bolsters and putting a shear stress on the pivot pin rather than forcing apart the bolsters.

2. The knife as claimed in claim 1 wherein the configuration of each said mating surface is circular with the forward edge of each said bolster being convex and the rearward end of the blade being concave.

3. The knife as claimed in claim 1 further comprising means for locking the blade in an opened position.

4. The knife as claimed in claim 1 further comprising tension means acting on the pivot pin to keep said blade in contact with said mating surfaces.

5. The knife as claimed in claim 4 wherein said means includes an integral spring operably attached to said blade.

6. The knife as claimed in claim 4 wherein said means includes a coil spring operably attached to said blade.

7. The knife as claimed in claim 4 wherein said means includes a bar spring operably attached to said blade.

8. The knife as claimed in claim 4 wherein said means includes a leaf spring operably attached to said blade.

9. A knife adapted to be folded comprising the combination of a blade sandwiched between a pair of bolsters which are connected to a handle and a pivot pin extending between the bolsters and through an end of the blade, the improvement wherein the forward edge of each said bolster has a surface of an arcuate configuration and the confronting rearward end of the blade has a surface of an arcuate configuration substantially similar to that of the bolsters to permit the blade and bolsters to meet in sliding engagement when the blade is in an opened or closed position thereby transferring any lateral forces acting on the blade to the bolsters and putting a shear stress on the pivot pin instead of forcing the bolsters apart.

10. The improvement as claimed in claim 9 wherein said arcuate surfaces are of a circular configuration with each said surface of the bolster being convex and each said surface of the blade being concave.

11. The improvement as claimed in claim 9 wherein means is provided for locking the blade in an opened position.

12. The improvement as claimed in claim 9 further including means for providing tension to keep said blade in contact with said bolsters.

13. The improvement as claimed in claim 12 wherein said means is operably associated with said blade and acts upon said pivot pin.

* * * * *